US007675413B2

(12) United States Patent
Watts et al.

(10) Patent No.: US 7,675,413 B2
(45) Date of Patent: Mar. 9, 2010

(54) WIRELESS INTRUSION SENSOR FOR A CONTAINER

(75) Inventors: Fred S. Watts, New Freedom, PA (US); Gabriel E. Concari, Eldersburg, MD (US); Harry B. Taylor, Layfayette, CO (US); William E. Pugh, Towson, MD (US); Kelton Lovell, Baltimore, MD (US); Robert Bradus, Bel Air, MD (US); Lawrence Milburn, Bel Air, MD (US); Craig Patton, Boulder, CO (US)

(73) Assignee: Cattail Technologies, LLC, Towson, MD (US)

( * ) Notice: Subject to any disclaimer, the term of this patent is extended or adjusted under 35 U.S.C. 154(b) by 1140 days.

(21) Appl. No.: 11/272,506

(22) Filed: Nov. 10, 2005

(65) Prior Publication Data

US 2006/0109114 A1 May 25, 2006

Related U.S. Application Data

(60) Provisional application No. 60/626,757, filed on Nov. 11, 2004.

(51) Int. Cl.
*G08B 1/08* (2006.01)
*G08B 13/00* (2006.01)
*G08B 13/08* (2006.01)

(52) U.S. Cl. ..... 340/539.22; 340/539.1; 340/693.5; 340/541; 340/542; 340/545.1; 340/545.6; 340/309.16

(58) Field of Classification Search ..... None
See application file for complete search history.

(56) References Cited

U.S. PATENT DOCUMENTS 4,333,093 A * 6/1982 Raber et al. ..... 340/566

(Continued)

FOREIGN PATENT DOCUMENTS

DE 92 09 214 9/1992

(Continued)

OTHER PUBLICATIONS

European Search Report completed on Apr. 27, 2007.

(Continued)

*Primary Examiner*—Julie Lieu
(74) *Attorney, Agent, or Firm*—Harness, Dickey & Pierce PLC

(57) ABSTRACT

An intrusion sensing device includes an intrusion detection sensor enclosed within a housing and operable to detect an intrusion into a container. A mounting detection mechanism contacts the surface of the container when the housing is mounted thereto and is operable to detect when the housing is not in contact with the surface of the container. An access detection mechanism is operably connected to an access panel of the housing and operable to detect removal of the access panel from the housing. A control module is operable in a setup mode and an active mode. The control module is adapted to receive an alarm message from the intrusion detection sensor and operable to initiate an alarm event during the setup mode which varies from an alarm event initiated during the active mode. A wireless transmitter is operable to transmit an alarm indication signal to a remote monitoring system.

48 Claims, 7 Drawing Sheets

U.S. PATENT DOCUMENTS

| | | | | |
|---|---|---|---|---|
| 4,520,350 | A | 5/1985 | Huang | |
| 4,622,541 | A | 11/1986 | Stockdale | |
| 4,688,244 | A | 8/1987 | Hannon et al. | |
| 4,750,197 | A | 6/1988 | Denekamp et al. | |
| 4,763,937 | A * | 8/1988 | Sittnick et al. | 292/251.5 |
| 4,845,470 | A | 7/1989 | Boldt, Jr. | |
| 4,857,912 | A | 8/1989 | Everett, Jr. et al. | |
| 5,023,595 | A | 6/1991 | Bennett | |
| 5,051,725 | A * | 9/1991 | Caccitolo | 340/571 |
| 5,481,245 | A | 1/1996 | Moldaysky | |
| 5,615,247 | A | 3/1997 | Mills | |
| 5,689,243 | A | 11/1997 | Bianco | |
| 5,708,417 | A * | 1/1998 | Tallman et al. | 340/539.23 |
| 5,729,199 | A | 3/1998 | Cooper | |
| 5,774,053 | A | 6/1998 | Porter | |
| 5,808,198 | A | 9/1998 | Ward et al. | |
| 5,877,684 | A | 3/1999 | Lu | |
| 5,939,982 | A | 8/1999 | Gagnon et al. | |
| 5,942,974 | A | 8/1999 | Pfreundschuh et al. | |
| 5,959,529 | A | 9/1999 | Kail, IV | |
| 6,046,675 | A | 4/2000 | Hanna | |
| 6,084,511 | A | 7/2000 | Kil | |
| 6,118,375 | A | 9/2000 | Duncan | |
| 6,133,842 | A | 10/2000 | Gariepy | |
| 6,181,244 | B1 | 1/2001 | Hall et al. | |
| 6,252,505 | B1 | 6/2001 | Bade | |
| 6,271,753 | B1 | 8/2001 | Shukla | |
| 6,281,793 | B1 | 8/2001 | Haimovich et al. | |
| 6,297,735 | B1 | 10/2001 | Abel | |
| 6,297,745 | B1 | 10/2001 | Meier | |
| 6,310,549 | B1 * | 10/2001 | Loftin et al. | 340/547 |
| 6,369,708 | B2 | 4/2002 | Carney | |
| 6,400,267 | B1 * | 6/2002 | Gordon-Levitt et al. | 340/547 |
| 2004/0041706 | A1 | 3/2004 | Stratmoen et al. | |
| 2004/0196153 | A1 * | 10/2004 | Cockburn et al. | 340/686.1 |

FOREIGN PATENT DOCUMENTS

| | | |
|---|---|---|
| EP | 0044725 | 1/1982 |
| FR | 2 626 395 | 7/1989 |
| GB | 2103406 | 2/1983 |
| GB | 2189031 | 10/1987 |

OTHER PUBLICATIONS

Ivonics Wireless Corporation, Product Catalog, 2004-2005.

* cited by examiner

WIRELESS INTRUSION SENSOR FOR A CONTAINER

CROSS-REFERENCE TO RELATED APPLICATIONS

This application claims the benefit of U.S. Provisional Application No. 60/626,757, filed on Nov. 11, 2005. The disclosure of the above application is incorporated herein by reference.

FIELD OF THE INVENTION

The present invention relates to intrusion detection sensors, and more particularly to wireless intrusion detection sensors that detect an intrusion of a container.

BACKGROUND OF THE INVENTION

Construction sites and other industrial job site locations are typically unsecured areas. Loss and theft of tools and other construction equipment is a common occurrence at such sites. For example, a job site may remain exposed to the threat of theft and/or vandalism at night. The tools and/or equipment at an industrial job site typically include very expensive power tools and construction materials. Theft of such items amounts to considerable losses and expenses. While contractors may utilize security guards or guard dogs to ensure the security of tools and other equipment at night, this is very expensive. Additionally, theft and/or vandalism may still occur during the day.

Contractors commonly utilize portable containers that house large numbers of tools and other equipment. For example, a contractor may utilize one or more metallic gang boxes. A contractor may attempt to prevent unauthorized access to the insides of containers to safeguard the tools and other equipment. For example, the contractor may utilize devices such as locks, chains, and/or straps to secure the containers. However, unauthorized individuals may still attempt to tamper with such devices during the day or night to gain access to the insides of the containers. Therefore, such devices do not guarantee the security of the containers. Additionally, a contractor may not be aware that attempted thefts have taken place.

In one method, a contractor utilizes sensors that detect when containers that house tools or other equipment are opened. One or more sensors may be wired together and communicate with an alarm system. However, since the sensors and the alarm system are wired, such systems are typically applicable only for indoor use. For example, multiple containers may be very far apart on a job site. In this case, long runs of wire are required to link all of the containers to the alarm system, which is very expensive. Additionally, the portable nature of the containers makes wired alarm systems difficult and time consuming to install.

SUMMARY OF THE INVENTION

An intrusion sensing device according to the present invention is adapted for use with a container and includes an intrusion detection sensor enclosed within a housing and operable to detect an intrusion into a container. The housing is configured to be mounted to a surface of the container. A mounting detection mechanism contacts the surface of the container when the housing is mounted thereto and is operable to detect when the housing is not in contact with the surface of the container. An access detection mechanism is operably connected to an access panel of the housing and operable to detect removal of the access panel from the housing. The access panel provides access to an enclosure the houses a power source for the intrusion sensing device.

In other features, a control module is operable in a setup mode and an active mode. The control module is adapted to receive an alarm message from the intrusion detection sensor and operable to initiate an alarm event during the setup mode which varies from an alarm event initiated during the active mode. The control module initiates the alarm event during the setup mode when the control module receives the alarm message from the intrusion detection sensor. The control module receives the alarm message from the intrusion detection sensor when the intrusion detection sensor detects an intrusion into the container. The control module is adapted to receive an alarm message from the mounting detection mechanism and an alarm message from the access detection mechanism.

In still other features of the invention, the control module initiates the alarm event during the active mode when the control module receives at least one of the alarm message from the intrusion detection sensor, the alarm message from the mounting detection mechanism, and/or the alarm message from the access detection mechanism. The control module receives the alarm message from the mounting detection mechanism when the housing is not in contact with the surface of the container and the alarm message from the access detection mechanism when the access panel is removed from the housing. A wireless transmitter communicates with the control module and is operable to transmit an alarm indication signal to a remote monitoring system. The wireless transmitter transmits the alarm indication signal to the remote monitoring system during the active mode when the control module receives at least one of the alarm message from the intrusion detection sensor, the alarm message from the mounting detection mechanism, and/or the alarm message from the access detection mechanism.

In yet other features, the intrusion detection sensor is a vibration sensor. The control module includes a timer. The control module resets the timer when the control module receives at least one of the alarm message from the intrusion detection sensor, the alarm message from the mounting detection mechanism, and/or the alarm message from the access detection mechanism. The control module does not initiate the alarm event during the setup mode or the alarm event during the active mode and the wireless transmitter does not transmit the alarm indication signal to the remote monitoring system unless the timer is expired. The timer has a first maximum value during the setup mode and a second maximum value during the active mode. The first maximum value is less than the second maximum value.

In still other features of the invention, the control module activates an audible indicator during at least one of the alarm event during the setup mode and/or the alarm event during the active mode. The control module sets the audible indicator at a first volume during the setup mode and at a second volume during the active mode. The first volume is less than the second volume. The control module activates a visible indicator during at least one of the alarm event during the setup mode and/or the alarm event during the active mode. The access panel provides access to a sensitivity adjustment mechanism that adjusts a sensitivity of the intrusion detection sensor. The access panel provides access to an actuator that switches the control module between the setup and active modes when the actuator is triggered. The control module automatically operates in the setup mode when the access panel is removed from the housing.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1B:
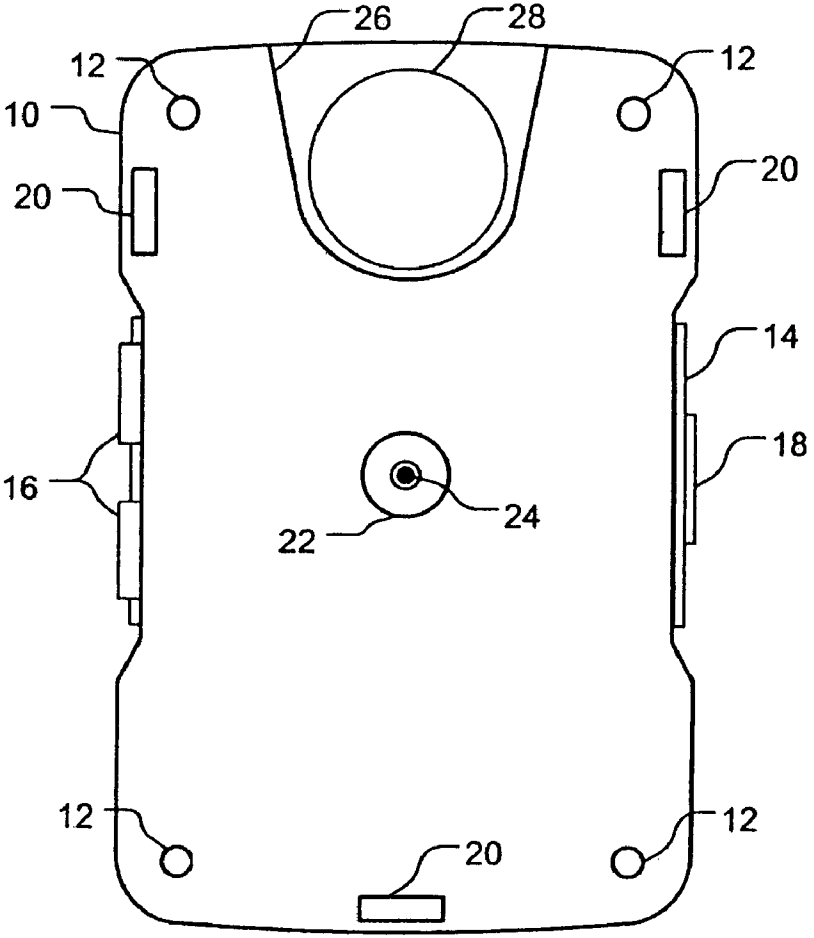
FIG. 1B is a bottom view of the container intrusion sensor in FIG. 1A.

The following description of the preferred embodiment(s) is merely exemplary in nature and is in no way intended to limit the invention, its application, or uses. For purposes of clarity, the same reference numbers will be used in the drawings to identify similar elements. As used herein, the term module and/or device refers to an application specific integrated circuit (ASIC), an electronic circuit, a processor (shared, dedicated, or group) and memory that execute one or more software or firmware programs, a combinational logic circuit, and/or other suitable components that provide the described functionality.

Figure 1A:
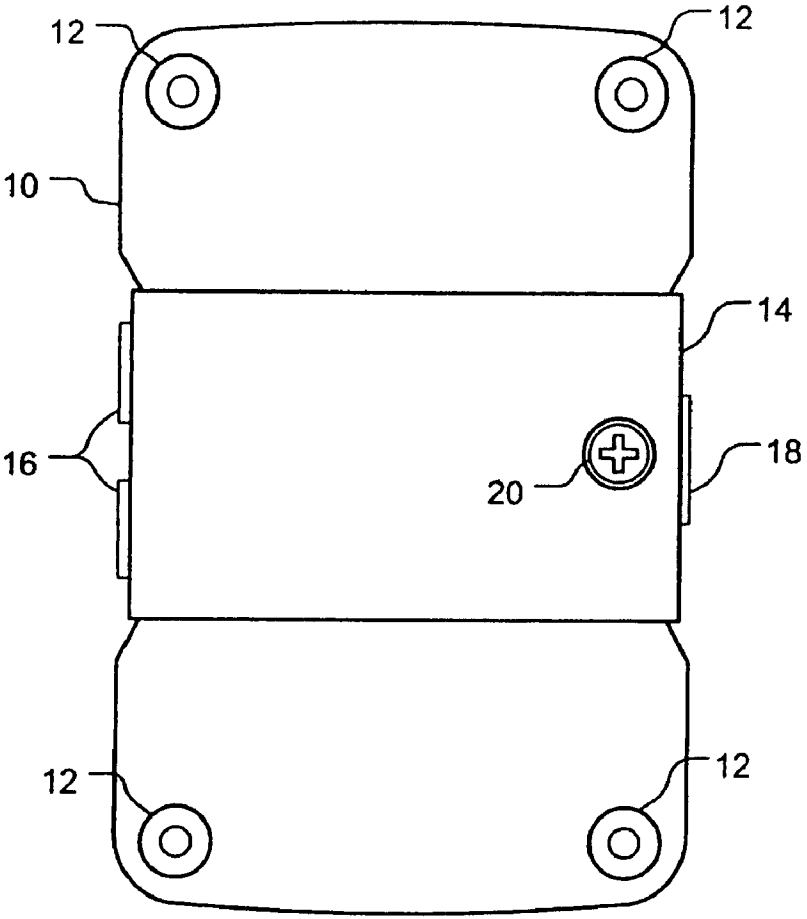
FIG. 1A is a top view of an exemplary wireless container intrusion sensor according to the present invention.
Figure 1D:
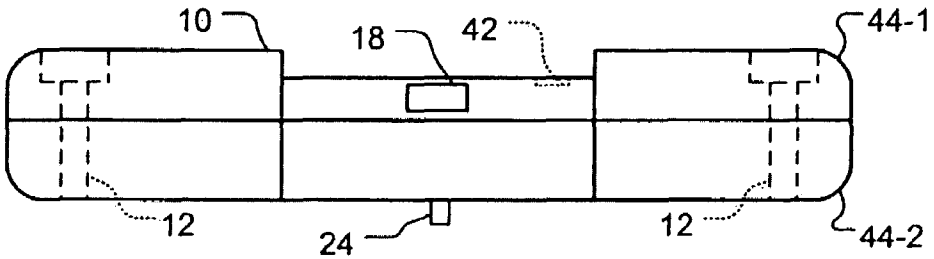
FIG. 1D is a side view of the container intrusion sensor in FIG. 1A with the access panel removed.

Referring to FIGS. 1A-1D, an exemplary container intrusion sensor 10 detects a security breach of a container. For example, the container intrusion sensor 10 detects the intrusion of the container on which the container intrusion sensor 10 is mounted. In this case, an intrusion is detected when the container is opened and/or when objects are removed from the container. The container intrusion sensor 10 initiates an alarm event when an intrusion is detected. For example, the container intrusion sensor 10 may activate an alarm indicator during the alarm event. The container intrusion sensor 10 also wirelessly communicates with a remote monitoring system to indicate the intrusion. As shown in FIG. 1A, the container intrusion sensor 10 includes holes 12 that pass through the housing of the container intrusion sensor 10. The holes 12 allow the container intrusion sensor 10 to be fastened to a surface of a container. For example, screws or other fasteners may be utilized to fasten the container intrusion sensor 10 to a surface of a container.

Portions of the holes 12 are preferably recessed with respect to a top surface of the container intrusion sensor 10 so that the top surface remains flush. The container intrusion sensor 10 includes an access panel 14 that prevents unauthorized access to interior controls of the container intrusion sensor 10. The access panel 14 rotates about a hinge 16 and snaps open and shut against the surface of the container intrusion sensor 10 with a finger latch 18. A screw 20 also fastens the access panel 14 shut to deter unauthorized access to the interior controls of the container intrusion sensor 10.

As shown in FIG. 1B, a bottom surface of the container intrusion sensor 10 includes magnets 20 that allow the container intrusion sensor 10 to be removably fixed to a surface of a container that is metallic. For example, the magnets 20 may hold the container intrusion sensor 10 in place while screws are utilized to fasten the container intrusion sensor 10 to the container. The bottom surface of the container intrusion sensor 10 also includes a surface tamper device 22. The surface tamper device 22 detects when the container intrusion sensor 10 is removed from a surface of a container. In an exemplary embodiment, the surface tamper device 22 includes a plunger 24 that is spring-loaded. Therefore, the plunger 24 extends past the bottom surface of the container intrusion sensor 10 when the container intrusion sensor 10 is not mounted on a surface of a container. The plunger 24 includes a magnet that closes a circuit of an internal control module when the container intrusion sensor 10 is mounted on a surface of a container. The circuit opens when the plunger 24 extends past the bottom surface of the container intrusion sensor 10, which initiates an alarm event.

The bottom surface of the container intrusion sensor 10 includes a notch 26. An audible indicator 28 is mounted in the notch 26 so that the bottom surface of the container intrusion sensor 10 remains flush. For example, the audible indicator 28 may be a speaker or another audible indicator. The audible indicator 28 is activated when the surface tamper device 22 detects that the bottom surface of the container intrusion sensor 10 no longer contacts a surface of a container.

Figure 1C:
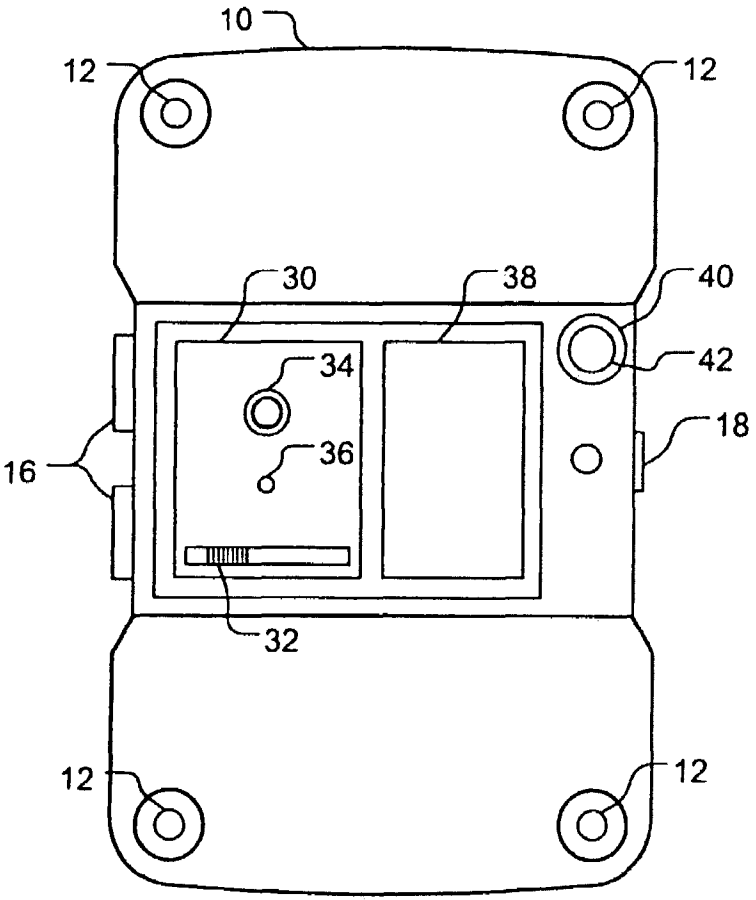
FIG. 1C is a top view of the container intrusion sensor in FIG. 1A with an access panel removed.

As shown in FIG. 1C, the access panel 14 is used to access an interior compartment of the container intrusion sensor 10. A control panel 30 includes a sensitivity adjustment device 32. The sensitivity adjustment device 32 adjusts a sensitivity of a vibration sensor that is housed inside the container intrusion sensor 10. For example, the sensitivity adjustment device 32 may be a sliding control that adjusts a resistance of a rheostat in the vibration sensor. Alternatively, the sensitivity adjustment device 32 may include one or more buttons that communicate with a control module to increase/decrease the sensitivity of the vibration sensor when pressed.

The vibration sensor detects an intrusion of a container on which the container intrusion sensor 10 is mounted. The container intrusion sensor 10 activates the audible indicator 28 when the vibration sensor detects an intrusion. The container intrusion sensor 10 is capable of operating in a setup mode and a active mode, as will be described in further detail below. During the setup mode, the sensitivity of the internal vibration sensor may be adjusted so that the container intrusion sensor 10 functions as desired. The control panel 30 also includes an actuator 34. For example, the actuator 34 may be a push-button, a toggle switch, or another actuator. The container intrusion sensor 10 switches between the setup and active modes when the actuator 34 is triggered.

The control panel 30 also includes a visible indicator 36. The visible indicator 36 indicates when the vibration sensor detects an intrusion during the setup mode. For example, the visible indicator 36 may be a light-emitting diode (LED) or another visible indicator. In this case, it is not necessary for the container intrusion sensor 10 to activate the audible indicator 28 during the setup mode. Alternatively, the container intrusion sensor 10 may activate the audible indicator 28 at a lower volume during the setup mode than during the active mode.

The interior compartment also allows access to a battery compartment 38 that houses one or more batteries to power the container intrusion sensor 10. The interior compartment also includes an access tamper device 40. The access tamper device 40 detects when the access panel 14 is open. The access tamper device 40 includes a notch 42 that receives a magnet mounted on the access panel 14 when the access panel 14 is closed. The presence of the magnet in the notch 42 closes a circuit of an internal control module when the access panel 14 closed. The circuit opens when the access panel 14 is opened and the magnet is removed from the notch 42, which initiates an alarm event. For example, the container intrusion sensor 10 activates the audible indicator 28 during the active mode when the access tamper device 40 detects that the access panel 14 is open.

In an exemplary embodiment, the container intrusion sensor 10 includes a housing comprising two sections 44-1 and 44-2. The two sections 44-1 and 44-2 are preferably environmentally sealed to prevent water and/or dust from entering the inside of the container intrusion sensor 10. For example, a gasket seal along the perimeter of the container intrusion sensor 10 between the two sections 44-1 and 44-2 provides an effective seal. Additionally, the container intrusion sensor 10 may include tamper-proof fasteners that prevent unauthorized separation of the two sections 44-1 and 44-2. The housing of the container intrusion sensor 10 is preferably rugged, durable, and able to withstand a wide range of temperature variations.

Figure 2:
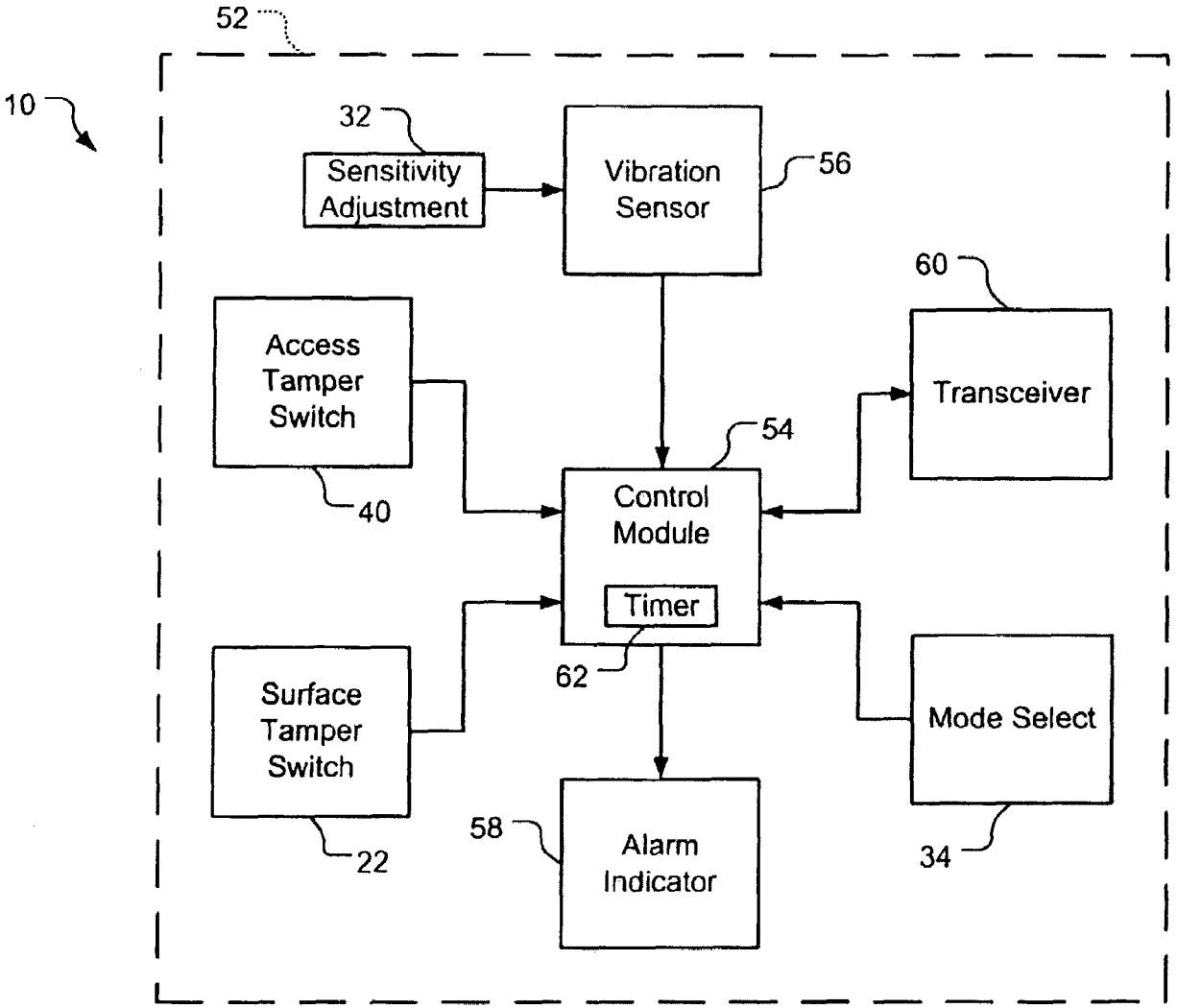
FIG. 2 is a functional block diagram of a wireless intrusion detection system according to the present invention.

Referring now to FIG. 2, the container intrusion sensor 10 includes an intrusion detection system 52 according to the present invention. The intrusion detection system 52 includes a control module 54 that communicates with a vibration sensor 56. The vibration sensor 56 detects an intrusion of a container on which the container intrusion sensor 10 is mounted. The vibration sensor 56 transmits an alarm message to the control module 54 when an intrusion is detected. The sensitivity adjustment device 32 communicates with the vibration sensor 56 and adjusts a sensitivity of the vibration sensor 56. For example, if the sensitivity of the vibration sensor 56 is increased, the vibration sensor 56 is more likely to detect an intrusion when less vibration is generated as compared to the original sensitivity setting. The sensitivity adjustment device 32 does not adjust the actual sensitivity of a sensing element included in the vibration sensor. Rather, the sensitivity adjustment device 32 adjusts the way a signal generated by the sensing element is processed in order to detect only vibrations that are greater than a desired magnitude, as will be described in further detail below.

The control module 54 communicates with the access tamper device 40. The access tamper device 40 detects when the access panel 14 to the interior compartment of the container intrusion sensor 10 is open. If the access panel 14 is open, the access tamper device 40 transmits an alarm message to the control module 54. The control module 54 also communicates with the surface tamper device 22. The surface tamper device 22 detects when the container intrusion sensor 10 is removed from a surface of a container. When the container intrusion sensor 10 is removed from a surface of a container, the surface tamper device 22 transmits an alarm message to the control module 54.

The control module 54 operates in setup and active modes. The actuator 34 on the control panel 30 switches the control module 54 between the setup and active modes when the actuator 34 is triggered. The control module 54 communicates with an alarm indicator 58 and a wireless transceiver 60. For example, the wireless transceiver 60 may be a radio frequency (RF) transceiver. However, those skilled in the art can appreciate that the wireless transceiver 60 may communicate in any wireless communications frequency such as 900 MHz. Additionally, the wireless transceiver 60 may utilize one-way or two-way wireless communications. The alarm indicator 58 may include the visible indicator 36, the audible indicator 28, and/or another type of alarm indicator 58.

The wireless transceiver 60 wirelessly communicates with a remote monitoring system. In an exemplary embodiment, the wireless transceiver 60 is manufactured by Inovonics Wireless Corporation and utilizes "EchoStream" multiple frequency technology. However, other wireless transceivers 60 may be used. The control module 54 activates the alarm indicator 58 during the setup mode when the vibration sensor 56 detects an intrusion. In an exemplary embodiment, the control module 54 does not activate the alarm indicator 58 during the setup mode when the access tamper device 40 detects that the access panel 14 is open or when the surface tamper device 22 detects that the container intrusion sensor 10 is removed from a surface of a container. This is because the access panel 14 is typically open and/or the container intrusion sensor 10 is not mounted on a surface of a container during testing of the container intrusion sensor 10.

The control module 54 activates the alarm indicator 58 during the active mode when the vibration sensor 56 detects an intrusion, the access tamper device 40 detects that the access panel 14 is open, and/or the surface tamper device 22 detects that the container intrusion sensor 10 is not mounted on a surface of a container. In an exemplary embodiment and when the alarm indicator 58 is the audible indicator 28, the control module 54 activates the audible indicator 28 at a first volume during the setup mode and at a second volume during the active mode. For example, the first volume may be less than the second volume. This is because it is not necessary for the audible indicator 28 to be very loud during testing of the container intrusion sensor 10.

The wireless transceiver 60 transmits an intrusion indication signal to the remote monitoring system during the active mode when the vibration sensor 56 detects an intrusion, the access tamper device 40 detects that the access panel 14 is open, and/or the surface tamper device 22 detects that the container intrusion sensor 10 is removed from a surface of a container. In an exemplary embodiment, the wireless transceiver 60 does not transmit the intrusion indication signal to the remote monitoring system during the setup mode. This prevents unnecessary intrusion indication to the remote monitoring system during testing and conserves power.

The control module 54 includes a timer 62. The timer 62 is reset when the control module 54 activates the alarm indicator 58. The control module 54 does not activate the alarm indicator 58 unless the timer 62 is expired. Additionally, the wireless transceiver 60 does not transmit the intrusion indication signal to the remote monitoring system unless the timer 62 is expired. This prevents the control module 54 and the wireless transceiver 60 from redundantly indicating an intrusion of a container when the intrusion is continuously detected.

As long as an intrusion is detected while the timer 62 is running, the timer 62 is reset. After the timer 62 expires and another intrusion is detected, the control module 54 and/or the wireless transceiver 60 indicate an intrusion again. The maximum value of the timer 62 during the setup mode is preferably less than the maximum value of the timer 62 during the active mode. For example, the maximum value of the timer 62 may be 1 second during the setup mode and 10 minutes during the active mode. This expedites a procedure to test the container intrusion sensor 10.

Figure 3:
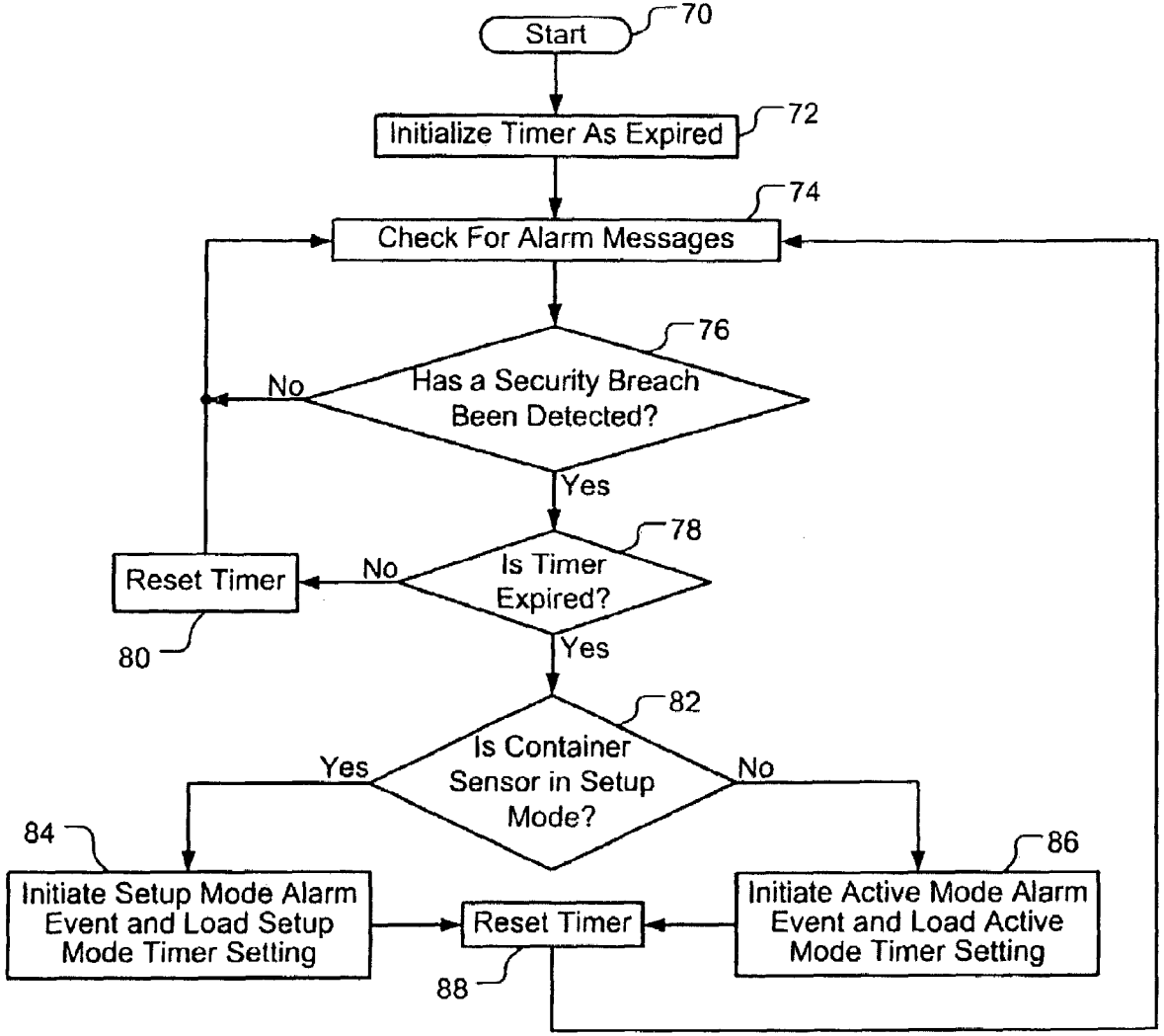
FIG. 3 is a flowchart illustrating steps performed by the control module to activate an alarm indicator.

Referring now to FIG. 3, an intrusion detection algorithm begins in step 70. In step 72, the control module 54 initializes the value of the timer 62 so that the timer 62 is expired. In step 74, the control module 54 checks for alarm messages from the vibration sensor 56, the surface tamper device 22, and the access tamper device 40. In step 76, the control module 54 determines whether a security breach has been detected. If the vibration sensor 56 does not detect a security breach, control returns to step 74. If the vibration sensor 56 detects a security breach, the control module 54 determines whether the timer is expired in step 78. If the timer 62 is not expired, the control module 54 resets the timer 62 in step 80 and control returns to step 74. If the timer 62 is expired, control determines whether the control module 54 is operating in the setup mode in step 82.

If the control module 54 is operating in the setup mode, control proceeds to step 84. In step 84, the control module 54 initiates an alarm event associated with the setup mode and loads the setup mode maximum timer 62 value. For example, the control module 54 may activate the visible indicator 36 and activate the audible indicator 28 at a first volume during the alarm event associated with the setup mode. If the control module 54 is operating in the active mode, control proceeds from step 82 to step 86.

In step 86, the control module 54 initiates an alarm event associated with the active mode and loads the active mode maximum timer 62 value. For example, the control module 54 may activate the audible indicator 28 at a second volume during the alarm event associated with the active mode. Alternatively or additionally, the wireless transceiver 60 may transmit an alarm indication signal to a remote monitoring system during the alarm event associated with the active mode. Control proceeds from both steps 84 and 86 to step 88. In step 88, the control module 54 resets the timer 62 and control returns to step 74.

Figure 4:
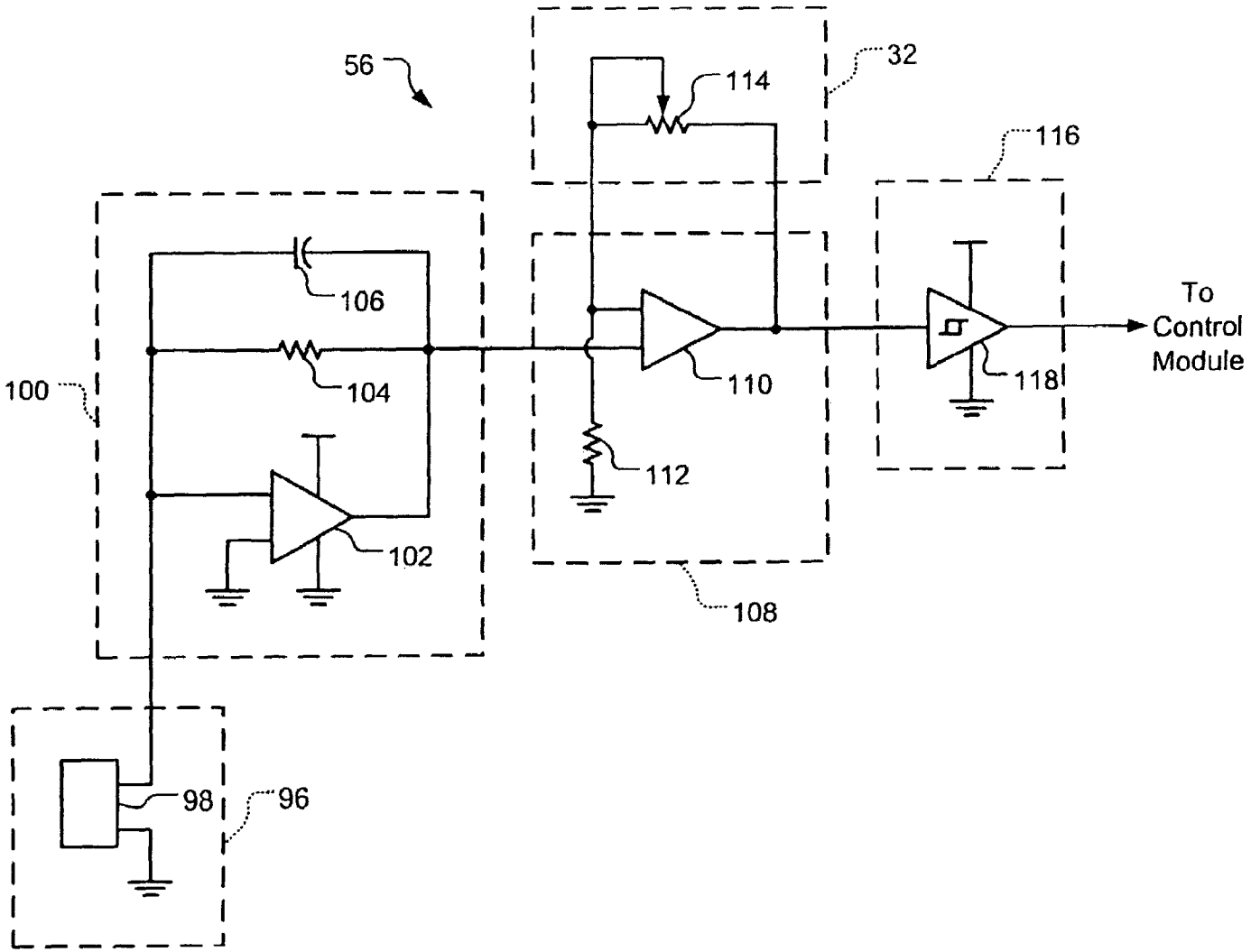
FIG. 4 is a functional block diagram and electrical schematic of an exemplary vibration sensor.

Referring now to FIG. 4, an exemplary vibration sensor 56 includes a sensing element 96. The sensing element 96 generates a first vibration signal. A value of the first vibration signal is based on a level of vibration that the sensing element 96 senses. The sensing element 96 includes a vibration detection element 98. For example, the vibration detection element 98 may be a piezoelectric device. A first terminal of the vibration detection element 98 connects to a ground potential.

A transimpedance amplifier 100 receives the first vibration signal, performs preliminary amplification, and generates a first amplified vibration signal. The transimpedance amplifier 100 includes a first operational amplifier (opamp) 102, a first resistor 104 and a first capacitor 106. A second terminal of the vibration detecting element 98 connects to a first input of the first opamp 102, a first end of the first resistor 104, and a first end of the first capacitor 106. A first power terminal of the first opamp 102 connects to a supply potential. A second power terminal of the first opamp 102 and a second input of the first opamp 102 connect to a ground potential.

A gain amplifier 108 receives the first amplified vibration signal, performs adjustable amplification, and generates a second amplified vibration signal. The vibration sensor 56 optionally includes a filter between the transimpedance amplifier 100 and the gain amplifier 108 that filters the first amplified vibration signal. The sensitivity adjustment device 32 connects to the gain amplifier 108 and adjusts a gain of the gain amplifier 108 to adjust the sensitivity.

The gain amplifier 108 includes a second opamp 110 and a second resistor 112. An output of the first opamp 102 connects to a second end of the first resistor 104, a second end of the first capacitor 106, and a first input of the second opamp 110. The sensitivity adjustment device 32 includes an adjustable resistor 114. For example, the adjustable resistor 114 may be a rheostat device. A first end of the second resistor 112 connects to a ground potential. A second end of the second resistor 112 connects to a second input of the second opamp 110 and a first end of the adjustable resistor 114.

A threshold comparison module 116 receives the second amplified vibration signal and compares a value of the second amplified vibration signal to a threshold to determine when an intrusion occurs. The threshold comparison module 116 generates an intrusion detection signal. A value of the intrusion detection signal indicates whether the vibration sensor 56 detects an intrusion. The threshold comparison module 116 includes a Schmidt trigger device 118. An output of the second opamp 110 connects to a second end of the adjustable resistor 114 and an input of the Schmidt trigger device 118. A first bias terminal of the Schmidt trigger device connects to a supply potential. A second bias terminal of the Schmidt trigger device connects to a ground potential. The control module 54 detects the alarm message from the vibration sensor 56 based on the output of the Schmidt trigger.

Figure 5:
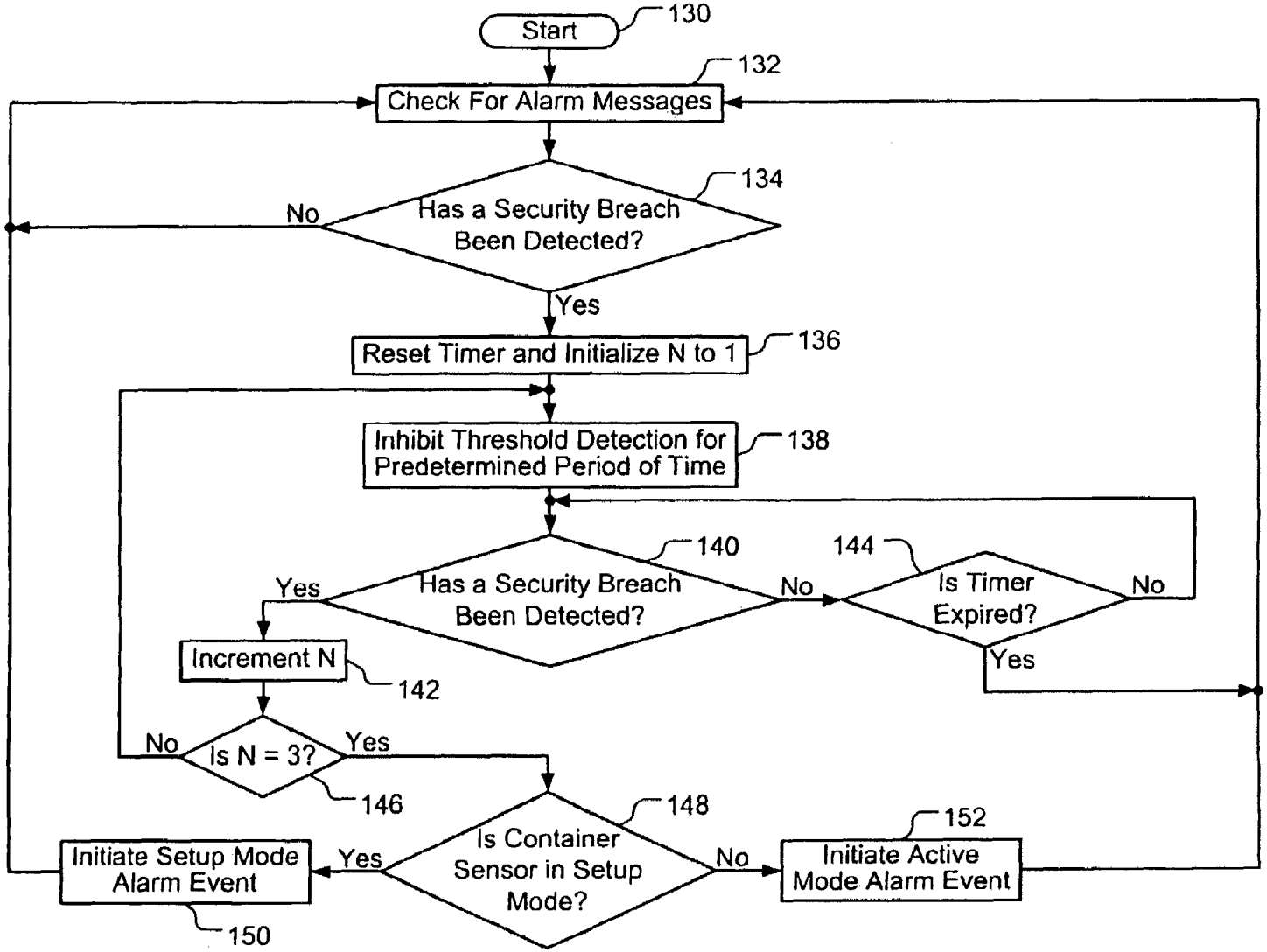
FIG. 5 is a flowchart illustrating steps performed by the control module to utilize a false trip filter before activating an alarm indicator.

Referring now to FIG. 5, there may be situations where the vibration sensor 56 is particularly susceptible to background noise and vibration. For example, thunder or a falling tree branch may generate sufficient vibration to produce a false security breach detection. Therefore, in an exemplary embodiment of the invention, the control module 54 initiates a waiting period after an initial detection of a security breach. For example, the waiting period may be set equal to ten seconds or another amount of time. During the waiting period, the control module 54 inhibits detection of a threshold trigger in the vibration sensor 56 for a predetermined period of time each time a security breach is detected. For example, the control module 54 may inhibit detection of a threshold trigger for 250 ms or another amount of time each time a security breach is detected.

After the control module 54 no longer inhibits detection of a threshold trigger, the control module 54 determines whether another security breach is detected. If the control module 54 detects a predetermined number of security breaches during the waiting period, the control module 54 proceeds to initiate an alarm event. For example, the control module 54 may detect 3 security breaches or another number of security breaches during the waiting period before initiating an alarm event. Otherwise, the original security breach is deemed a false alarm and the control module 54 initiates another full waiting period on a subsequent detection of a security breach.

A filtered intrusion detection algorithm begins in step 130. In step 132, the control module 54 checks for alarm messages from the vibration sensor 56, the surface tamper device 22, and the access tamper device 40. In step 134, the control module 54 determines whether a security breach has been detected. If the vibration sensor 56 does not detect a security breach, control returns to step 132. If the vibration sensor 56 detects a security breach, the control module resets the timer and sets the term N equal to 1 in step 136. For example, the timer may be reset to count down from ten seconds. In step 138, the control module 54 inhibits detection of a threshold trigger in the vibration sensor 56 for a predetermined period of time. For example, the control module 54 may inhibit detection of the threshold trigger for 250 ms.

In step 140, the control module 54 determines whether a security breach has been detected. If true, control proceeds to step 142. If false, the control module determines whether the timer is expired in step 144. If false, control returns to step 140. If true, control returns to step 132. In step 142, the control module increments the value of N. In step 146, the control module determines whether N is equal to 3. If false, control returns to step 138. If true, control determines whether the control module 54 is operating in the setup mode in step 148. If true, control proceeds to step 150. If false, the control module 54 initiates an alarm event associated with the active mode in step 152 and control returns to step 132. In step 150, the control module 54 initiates an alarm event associated with the setup mode and control returns to step 132. While the filtered intrusion detection algorithm illustrated in FIG. 5 only includes a single timer, a second timer may be incorporated to ensure a minimum amount of time between alarm events as shown in FIG. 3.

Figure 6:
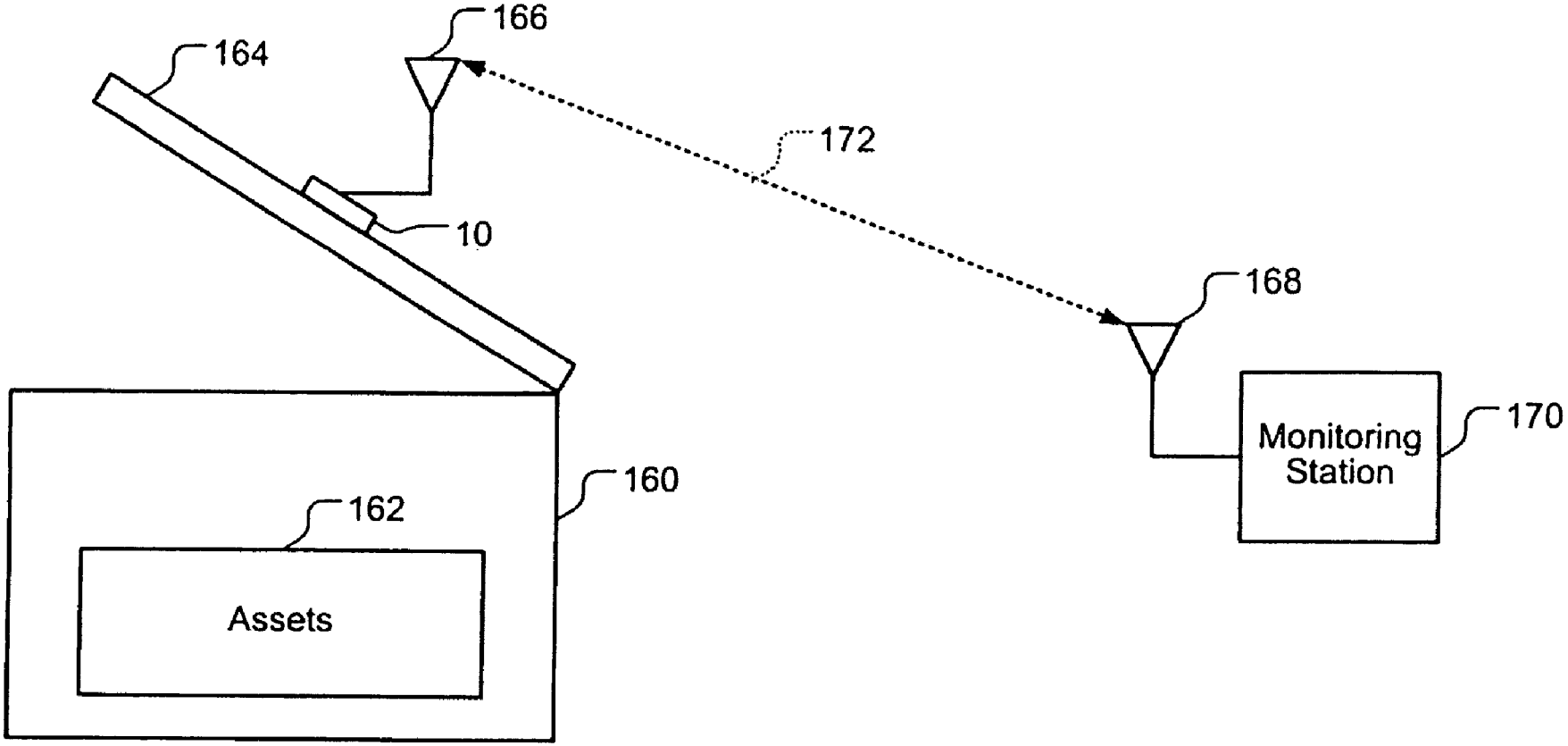
FIG. 6 illustrates communications between the container intrusion sensor and a remote monitoring system.

Referring now to FIG. 6, a portable container 160 houses assets 162. For example, the assets 162 may include tools or other construction materials on a job site. The container intrusion sensor 10 is mounted on an outer surface of the lid 164 on the portable container 160. However, the container intrusion sensor 10 may be mounted in other locations. An antenna 166 of the wireless transceiver 60 in the container intrusion sensor 10 is diagrammatically shown communicating with an antenna 168 of a monitoring station 170. The monitoring station 170 monitors a condition of the container intrusion sensor 10. The monitoring station 170 detects an intrusion of the portable container 160 when the wireless transceiver 60 transmits an intrusion indication signal 172 to the monitoring station 170.

A user of the monitoring station 170 may activate an alarm or contact law enforcement authorities or job site personnel upon receipt of the intrusion indication signal 172. Alternatively or additionally, the monitoring station 170 may automatically activate an alarm or contact appropriate parties. For example, the monitoring station 170 may automatically e-mail, page, voice dial, and/or text message a job site supervisor. The monitoring station 170 may be programmed to only take responsive action during certain times of day. For example, the monitoring station 170 may be programmed to only take responsive action during the night since the portable container 160 might only be used during the day. In an exemplary embodiment, the monitoring station 170 simultaneously communicates with multiple container intrusion sensors 10 that are fixed to portable containers 160 to monitor a large number of assets 162 across a large distance.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An intrusion sensing device adapted for use with a container, comprising:

an intrusion detection sensor enclosed within a housing and operable to detect an intrusion into a container, where the housing is configured to be mounted to a surface of the container;

a mounting detection mechanism that contacts the surface of the container when the housing is mounted thereto and is operable to detect when the housing is not in contact with the surface of the container;

an access detection mechanism operably connected to an access panel of the housing and operable to detect removal of the access panel from the housing, wherein the access panel provides access to an enclosure that houses a power source for the intrusion sensing device; and a control module operable in a setup mode and an active mode, wherein the control module is adapted to receive an alarm message from the intrusion detection sensor and operable to initiate an alarm event during the setup mode which varies from an alarm event initiated during the active mode.

2. The intrusion sensing device of claim 1 wherein the control module initiates the alarm event during the setup mode when the control module receives the alarm message from the intrusion detection sensor.

3. The intrusion sensing device of claim 1 wherein the control module receives the alarm message from the intrusion detection sensor when the intrusion detection sensor detects an intrusion into the container.

4. The intrusion sensing device of claim 1 wherein the control module is adapted to receive an alarm message from the mounting detection mechanism and an alarm message from the access detection mechanism.

5. The intrusion sensing device of claim 4 wherein the control module initiates the alarm event during the active mode when the control module receives at least one of the alarm message from the intrusion detection sensor, the alarm message from the mounting detection mechanism, and/or the alarm message from the access detection mechanism.

6. The intrusion sensing device of claim 4 wherein the control module receives the alarm message from the mounting detection mechanism when the housing is not in contact with the surface of the container and the alarm message from the access detection mechanism when the access panel is removed from the housing.

7. The intrusion sensing device of claim 4 further comprises a wireless transmitter that communicates with the control module and is operable to transmit an alarm indication signal to a remote monitoring system.

8. The intrusion sensing device of claim 7 wherein the wireless transmitter transmits the alarm indication signal to the remote monitoring system during the active mode when the control module receives at least one of the alarm message from the intrusion detection sensor, the alarm message from the mounting detection mechanism, and/or the alarm message from the access detection mechanism.

9. The intrusion sensing device of claim 1 wherein the intrusion detection sensor is a vibration sensor.

10. The intrusion sensing device of claim 7 wherein the control module includes a timer and wherein the control module resets the timer when the control module receives at least one of the alarm message from the intrusion detection sensor, the alarm message from the mounting detection mechanism, and/or the alarm message from the access detection mechanism.

11. The intrusion sensing device of claim 10 wherein the control module does not initiate the alarm event during the setup mode or the alarm event during the active mode and the wireless transmitter does not transmit the alarm indication signal to the remote monitoring system unless the timer is expired.

12. The intrusion sensing device of claim 10 wherein the timer has a first maximum value during the setup mode and a second maximum value during the active mode and wherein the first and second maximum values are not equal.

13. The intrusion sensing device of claim 10 wherein the control module does not initiate the alarm event during the setup mode or the alarm event during the active mode and the wireless transmitter does not transmit the alarm indication signal to the remote monitoring system unless the control module receives a predetermined number of additional alarm messages from at least one of the intrusion detection sensor, the mounting detection mechanism, and/or the access detection mechanism before the timer expires.

14. The intrusion sensing device of claim 1 wherein the control module activates an audible indicator during at least one of the alarm event during the setup mode and/or the alarm event during the active mode.

15. The intrusion sensing device of claim 14 wherein the control module sets the audible indicator at a first volume during the setup mode and at a second volume during the active mode and wherein the first and second volumes are not equal.

16. The intrusion sensing device of claim 1 wherein the control module activates a visible indicator during at least one of the alarm event during the setup mode and/or the alarm event during the active mode.

17. The intrusion sensing device of claim 1 wherein the access panel provides access to an actuator that switches the control module between the setup and active modes when the actuator is triggered.

18. The intrusion sensing device of claim 1 wherein the control module automatically operates in the setup mode when the access panel is removed from the housing.

19. The intrusion sensing device of claim 1 wherein the access panel provides access to a sensitivity adjustment mechanism that adjusts a sensitivity of the intrusion detection sensor.

20. An intrusion sensing device adapted for use with a container, comprising:

a vibration sensor operable to detect vibrating motion of the intrusion sensing device and generate an alarm message when the vibrating motion exceeds an adjustable threshold value;

a sensitivity adjustment mechanism which enables an operator to adjust the threshold value; and a control module operable in a setup mode and an active mode, wherein the control module is adapted to receive the alarm message from the vibration sensor and operable to initiate an alarm event in response to the alarm message and following a defined time delay, such that the time delay in the setup mode is shorter than the time delay in the active mode.

21. The intrusion sensing device of claim 20 wherein the vibration sensor and the control module are enclosed within a housing that is configured to be mounted to a surface of a container and wherein the vibration sensor is operable to detect an intrusion into the container.

22. The intrusion sensing device of claim 21 further comprises:

a mounting detection mechanism that contacts the surface of the container when the housing is mounted thereto and is operable to generate an alarm message when the housing is not in contact with the surface of the container; and an access detection mechanism operably connected to an access panel of the housing and operable to generate an alarm message when the access panel is removed from the housing, wherein the access panel provides access to an enclosure the houses a power source for the intrusion sensing device.

23. The intrusion sensing device of claim 20 wherein the control module is operable to initiate an alarm event in response to the alarm message during the setup mode which varies from an alarm event initiated during the active mode.

24. The intrusion sensing device of claim 22 wherein the control module is adapted to receive the alarm message from the mounting detection mechanism and the alarm message from the access detection mechanism.

25. The intrusion sensing device of claim 24 wherein the control module initiates the alarm event during the active mode when the control module receives at least one of the alarm message from the vibration sensor, the alarm message from the mounting detection mechanism, and/or the alarm message from the access detection mechanism.

26. The intrusion sensing device of claim 24 further comprises a wireless transmitter that communicates with the control module and is operable to transmit an alarm indication signal to a remote monitoring system following the defined time delay.

27. The intrusion sensing device of claim 26 wherein the wireless transmitter transmits the alarm indication signal to the remote monitoring system during the active mode when the control module receives at least one of the alarm message from the vibration sensor, the alarm message from the mounting detection mechanism, and/or the alarm message from the access detection mechanism.

28. The intrusion sensing device of claim 24 wherein the control module resets the defined time delay when the control module receives at least one of the alarm message from the vibration sensor, the alarm message from the mounting detection mechanism, and/or the alarm message from the access detection mechanism.

29. The intrusion sensing device of claim 20 wherein the control module activates an audible indicator during the alarm event.

30. The intrusion sensing device of claim 29 wherein the control module sets the audible indicator at a first volume during the setup mode and at a second volume during the active mode and wherein the first volume is less than the second volume.

31. The intrusion sensing device of claim 20 wherein the control module activates a visible indicator during the alarm event.

32. The intrusion sensing device of claim 22 wherein the access panel provides access to an actuator that switches the control module between the setup and active modes when the actuator is triggered.

33. The intrusion sensing device of claim 22 wherein the control module automatically operates in the setup mode when the access panel is removed from the housing.

34. An intrusion sensing device adapted for use with a container, comprising:

at least one sensing element configured to detect a security breach relating to the intrusion sensing device and operable to generate an alarm message is response thereto; and a control module adapted to receive the alarm message from the sensing element and operable to initiate an initial security action in response to the alarm message, wherein the control module foregoes initiating a subsequent security action until a predefined period of time has elapsed since the initiation of the initial security actions, and wherein the control module is operable in a setup mode and an active mode and operable to initiate a security action during the setup mode which varies from a security action during the active mode.

35. The intrusion sensing device of claim 34 wherein the sensing element and the control module are enclosed within a housing that is configured to be mounted to a surface of a container and wherein the sensing element is operable to detect an intrusion into the container.

36. The intrusion sensing device of claim 35 further comprises:

a mounting detection mechanism that contacts the surface of the container when the housing is mounted thereto and is operable to generate an alarm message when the housing is not in contact with the surface of the container; and an access detection mechanism operably connected to an access panel of the housing and operable to generate an alarm message when the access panel is removed from the housing, wherein the access panel provides access to an enclosure that houses a power source for the intrusion sensing device.

37. The intrusion sensing device of claim 36 wherein the control module is adapted to receive the alarm message from the mounting detection mechanism and the alarm message from the access detection mechanism.

38. The intrusion sensing device of claim 37 wherein the control module initiates a security action when the control module receives at least one of the alarm message from the sensing element, the alarm message from the mounting detection mechanism, and/or the alarm message from the access detection mechanism.

39. The intrusion sensing device of claim 37 further comprises a wireless transmitter that communicates with the control module and is operable to transmit an alarm indication signal to a remote monitoring system.

40. The intrusion sensing device of claim 39 wherein the wireless transmitter transmits the alarm indication signal to the remote monitoring system when the control module receives at least one of the alarm message from the sensing element, the alarm message from the mounting detection mechanism, and/or the alarm message from the access detection mechanism.

41. The intrusion sensing device of claim 34 wherein the sensing element is a vibration sensor.

42. The intrusion sensing device of claim 34 wherein the predefined period of time is a first value during the setup mode and a second value during the active mode and wherein the first value is less than the second value.

43. The intrusion sensing device of claim 34 wherein the control module activates an audible indicator during the security action.

44. The intrusion sensing device of claim 43 wherein the control module sets the audible indicator at a first volume during the setup mode and at a second volume during the active mode and wherein the first volume is less than the second volume.

45. The intrusion sensing device of claim 34 wherein the control module activates a visible indicator during the security action.

46. The intrusion sensing device of claim 34 wherein the access panel provides access to a sensitivity adjustment mechanism that adjusts a sensitivity of the sensing element.

47. The intrusion sensing device of claim 34 wherein the access panel provides access to an actuator that switches the control module between the setup and active modes when the actuator is triggered.

48. The intrusion sensing device of claim 34 wherein the control module automatically operates in the setup mode when the access panel is removed from the housing.

* * * * *